US005326683A

United States Patent [19]

Katoh

[11] Patent Number: 5,326,683

[45] Date of Patent: Jul. 5, 1994

[54] SILVER HALIDE PHOTOGRAPHIC MATERIAL

[75] Inventor: Kazunobu Katoh, Kanagawa, Japan

[73] Assignee: Fuji Photo Film Co., Ltd., Kanagawa, Japan

[21] Appl. No.: 39,797

[22] Filed: Mar. 30, 1993

[30] Foreign Application Priority Data

Mar. 30, 1992 [JP] Japan ..... 4-102387

[51] Int. Cl.[5] ..... G03C 1/06; G03C 1/485

[52] U.S. Cl. ..... 430/596; 430/264; 430/598; 430/957

[58] Field of Search ..... 430/598, 264, 957, 596

[56] References Cited

U.S. PATENT DOCUMENTS 3,062,651 11/1962 Hillson ..... 96/95
5,061,594 10/1991 Okamura et al. ..... 430/598
5,085,971 2/1992 Katoh ..... 430/264
5,230,983 7/1993 Inoue et al. ..... 430/264

*Primary Examiner*—Thorl Chea
*Attorney, Agent, or Firm*—Sughrue, Mion, Zinn, Macpeak & Seas

[57] ABSTRACT

A silver halide photographic material comprising a support having thereon a previously fogged silver halide emulsion layer and a light-sensitive silver halide emulsion layer comprising at least one silver halide, wherein at least one of said previously fogged silver halide emulsion layer and a hydrophilic colloid layer adjacent thereto contains at least one hydrazine nucleating agent and at least one of said light-sensitive silver halide emulsion layer and a hydrophilic colloid layer adjacent thereto contains at least one redox compound capable of releasing a development restrainer when oxidized, and wherein said nucleating agent and said redox compound are contained in different layers.

16 Claims, 1 Drawing Sheet

SILVER HALIDE PHOTOGRAPHIC MATERIAL

FIELD OF THE INVENTION

This invention relates to a novel reversal photographic material which can be widely applied to silver halide photographic materials.

BACKGROUND OF THE INVENTION

The term "to form a reversal image" as used herein means that developing silver halide to a pattern reverse to a pattern obtained by exposing to light to thereby form an image.

Conventionally known reversal image forming methods include a DIR coupler reversal method. In this method, a light-sensitive silver halide emulsion layer containing a DIR coupler and a previously fogged light-insensitive silver halide emulsion layer containing a color coupler are provided on the same support. When color development is carried out after exposure, a development restrainer is released by the coupling reaction of the oxidation product of a development agent and the DIR coupler, and the restrainer is diffused in the color coupler layer to restrain the development of the color coupler layer, whereby a reversal color image can be provided.

However, black-and-white development, wherein a development reaction rapidly proceeds in comparison with color development, reversal by DIR has not be achieved as yet.

SUMMARY OF THE INVENTION

An object of the present invention is to provide a novel silver halide photographic material which gives a reversal image.

Another object of the present invention is to provide a novel silver halide photographic material which gives a reversal image by black-and-white development.

Still another object of the present invention is to provide a novel silver halide photographic material which gives a reversal image by using a DIR redox compound.

The above and other objects and advantages of the present invention are achieved by providing a silver halide photographic material comprising a support having thereon a previously fogged silver halide emulsion layer and a light-sensitive silver halide emulsion layer comprising at least one silver halide, wherein at least one of said previously fogged silver halide emulsion layer and a hydrophilic colloid layer adjacent thereto contains at least one hydrazine nucleating agent and at least one of said light-sensitive silver halide emulsion layer and a hydrophilic colloid layer adjacent thereto contains a redox compound which can release a development restrainer when oxidized, and wherein said nucleating agent and said redox compound are contained in different layers.

DETAILED DESCRIPTION OF THE INVENTION

Figure 1:
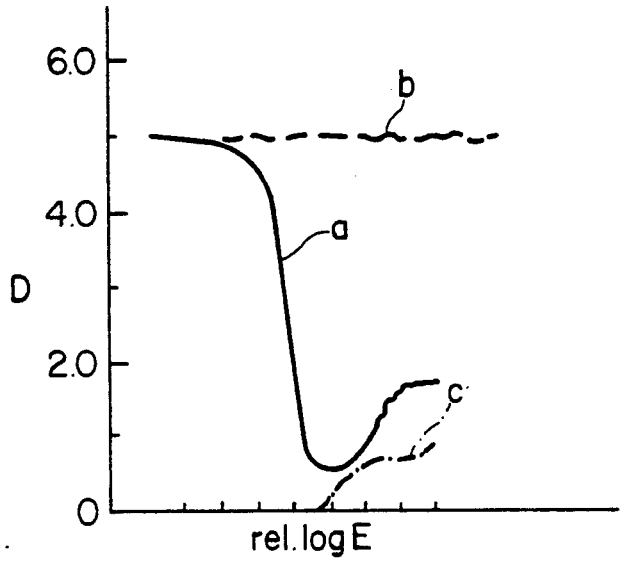
FIG. 1 is a characteristic curve of the photographic material obtained in Example 1, wherein the abscissa axis represents blackening density, and the ordinate axis represents relative exposure amount (rel. logE).

The present invention will be described in more detail below.

The previously fogged silver halide emulsion layer (the first emulsion layer) of the present invention may be light-sensitive or substantially light-insensitive. However, the other emulsion layer (the second emulsion layer) must be a light-sensitive layer which is not previously fogged.

The previously fogged silver halide emulsion layer will be described below.

The silver halide emulsion of the previously fogged silver halide emulsion layer can be fogged by conventional methods, for example, by treating the emulsion with light or chemically treating it. The fogging can be achieved by many methods. For example, chemical sensitization can be used until fogging is effected. Particularly good results can be obtained by the method described in *Science et Industrie Photographique,* 28, pp. 57–65 (January 1957). The silver halide grains of the emulsion can also be fogged by high-intensity light, reduction fogging agents such as thiourea dioxide and stannous chloride or compounds of a noble metal such as gold. Further, the silver halide grains can be fogged by the use of a combination of a reducing agent with a gold compound or a compound of a metal which is more electrically positive than silver, such as rhodium, platinum or iridium.

In the present invention, a photographic emulsion comprising reduction-fogged and gold-fogged silver halide grains, i.e., silver halide grains fogged by using both a reduction fogging agent and a gold fogging agent, is preferred from the viewpoint of high sensitivity and a reduction in Dmin. When each of the reduction fogging agent and the gold fogging agent is used at a low concentration in a combination as mentioned above, unique fogged silver halide grains having the characteristics that fog is rapidly lost by chemical bleaching can be obtained.

It is known that one equivalent of silver halide is reduced with one equivalent of a reducing agent to silver. To obtain the fogged silver halide grains having the characteristic that fog is rapidly lost by bleaching, a reduction fogging agent in an amount which is much less than one equivalent is used. Namely, about 0.06 milliequivalents or less of the reduction fogging agent per mol of silver halide is used to fog silver halide grains. In the practice of the present invention, about 0.0005 to about 0.06 milliequivalents, preferably about 0.001 to about 0.03 milliequivalents of the reduction fogging agent per mol of silver halide is generally used. When the concentration of the reducing agent is increased, a rapid loss in photographic speed is caused.

Examples of the reduction fogging agent which can be used in the practice of the present invention include hydrazine, phosphonium salts such as tetra(hydroxymethyl)phosphonium chloride and thiourea dioxide (which are described in U.S. Pat. Nos. 3,062,651 and 2,983,609); stannous salts such as stannous chloride (which are described in U.S. Pat. No. 2,487,850); polyamines such as diethylenetriamine (which are described in U.S. Pat. No. 2,519,698); polyamines such as spermine ($H_2N(CH_2)_3NH(CH_2)_4NH(CH_2)_3NH_2$) (which are described in U.S. Pat. No. 2,521,925); and bis(β-aminoethyl)sulfide and water-soluble salts thereof (which are described in U.S. Pat. No. 2,521,926).

The gold fogging agent which can be used in the practice of the present invention may be any gold salt which can be used to fog photographic silver halide grains. Examples of the gold fogging agent are described in U S. Pat. Nos. 2,399,083 and 2,642,361. Specific examples of the gold fogging agent include potassium chloroaurite, potassium aurithiocyanate, potassium chloroaurate, auric chloride and

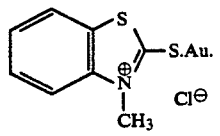

In the practice of the present invention, the concentration of the gold fogging agent can be widely varied. However, the gold fogging agent is generally used in a range of about 0.001 to 0.01 millimol per mol of silver halide. Potassium chloroaurate is particularly preferred as the gold fogging agent and is used at a concentration of not higher than about 5 mg, preferably about 0.5 mg to 4 mg per mol of silver halide.

It is preferred that when the gold fogging agent is used in combination with the reduction fogging agent, the principal component of the combination of the fogging agents is the gold fogging agent. Generally, the molar ratio of the gold fogging agent to the reduction fogging agent is from about 1:3 to about 20:1. The molar ratio of from about 2:1 to about 20:1 is preferred. Also, it is preferred that silver halide grains are fogged by first using the reduction fogging agent and then the gold fogging agent. However, these agents may be used in the reverse order, or these agents may be simultaneously used.

In the practice of the present invention, silver halide grains may be fogged before coating, or the grains may be fogged after coating when the first light-sensitive layer is coated after coating of the second light-sensitive emulsion layer. Reaction conditions for fogging silver halide grains can be widely varied, but the grains are generally fogged under reaction conditions where the pH is about 5 to 7, the pAg is about 7 to 9, and the temperature is about 40 to 100° C, preferably about 50° to 70° C.

Hydrazine derivatives represented by the following formula (I) are preferred as the nucleating agents used in the present invention.

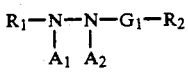

(I)

wherein $R_1$ represents an aliphatic or alicycl an aromatic group; $R_2$ represents a hydrogen atom, an alkyl group, an aryl group, an alkoxy group, an aryloxy group, an amino group or a hydrazino group; $G_1$ represents a —CO— group, an —$SO_2$— group, an —SO— group, a group represented by the following formula (II)

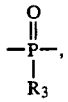

(II)

a —CO—CO— group, a thiocarbonyl group or an iminomethylene group; $A_1$ and $A_2$ each represents a hydrogen atom, or one Of $A_1$ and $A_2$ represents a hydrogen atom and the other represents an alkylsulfonyl group, an arylsulfonyl group or an acyl group; and $R_3$ has the same meaning as $R_2$; said groups represented by $R_1$, $R_2$, $R_3$, $A_1$, $A_2$ and $G_1$ may be substituted with at least one substituent.

The aliphatic or alicyclic group represented by $R_1$ in formula (I) includes a saturated or unsaturated aliphatic group, a straight-chain, branched or cyclic alkyl group preferably having 1 to 30 carbon atoms, particularly preferably 1 to 20 carbon atoms and the straight-chain, branched or cyclic alkyl group may be substituted.

The aromatic group represented by $R_1$ in formula (I) can be a monocyclic or bicyclic aryl group or an unsaturated heterocyclic group, preferably 5- or 6-membered group containing at least one of N, O and S atoms as a heteroatom. The unsaturated heterocyclic group and the aryl group may be fused together to form a fused ring. Examples of the heterocyclic group include a pyridinium group, a pyridyl group, a quiolyl group and a pyrimidyl group.

Preferably, $R_1$ is an aryl group, particularly preferably a group having a benzene ring.

The groups represented by $R_1$, especially, the aliphatic group or the aromatic group represented by $R_1$ may be substituted with at least one substituent. Typical examples of substituents include an alkyl group, an aralkyl group, an alkenyl group, an alkynyl group, an alkoxy group, an aryl group, a substituted amino group, a ureido group, a urethane group (e.g., alkoxycarbonyl amino and an aryloxycarbonyl amino), an aryloxy group, a sulfamoyl group, a carbamoyl group, an alkyl- or arylthio group, an alkyl- or arylsulfonyl group, an alkyl- or arylsulfinyl group, a hydroxy group, a halogen atom (e.g., F, Cl, Br and I), a cyano group, a sulfo group, an aryloxycarbonyl group, an acyl group (in the present invention an acyl moiety includes an aliphatic- and aromatic-acyl group), an alkoxycarbonyl group, an acyloxy group, a carbonamido group, a sulfonamido group, a carboxyl group, a phosphoric acid amido group, a diacylamino group, an imido group and a group represented by the following formula (III);

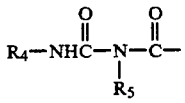

(III)

wherein $R_4$ and $R_5$ have the same meaning as $R_2$ and may be the same or different. These substituents may be further substituted with at least one of these substituents. The total number of carbon atoms of these substituents is not more than 30.

Preferred examples of the substituent groups of the aliphatic group or aromatic group represented by $R_1$ include an alkyl group (preferably having 1 to 20 carbon atoms), an aralkyl group (preferably having 7 to 30 carbon atoms), an alkoxy group (preferably having 1 to 20 carbon atoms), a substituted amino group (e.g., an amino group substituted by at least one alkyl group preferably having 1 to 20 carbon atoms), an acylamino group (preferably having 2 to 30 carbon atoms), a sulfonamido group (preferably having 1 to 30 carbon atoms), a ureido group (preferably having 1 to 30 carbon atoms) and a phosphoric acid amido group (preferably having 1 to 30 carbon atoms).

In formula (I), the alkyl group represented by $R_2$ is preferably an alkyl group having 1 to 4 carbon atoms, and the aryl group is preferably a monocyclic or bicyclic aryl group (e.g., a group having a benzene ring). An alkoxy group represented by $R_2$ preferably has 1 to 4 carbon atoms and an aryloxy group represented by $R_2$ preferably has 6 to 12 carbon atoms.

When $G_1$ is a —CO— group, $R_2$ is preferably hydrogen atom, an alkyl group (e.g., methyl group, trifluoromethyl group, 3-hydroxypropyl group, 3-methanesulfonamidopropyl group, phenylsulfonylmethyl group), an aralkyl group (e.g., o-hydroxybenzyl group) or an aryl group (e.g., phenyl group, 3,5-dichlorophenyl group, o-methanesulfonamidophenyl group, 4-methanesulfonylphenyl group, 2-(hydroxymethyl)phenyl group), with $R_2$ as a hydrogen atom being particularly preferred.

$R_2$ may be substituted. Examples of substituent groups include those already described above in the definition of the substituent groups for $R_1$.

$R_2$ may also be a group which causes the cleavage of the $G_1$-$R_2$ moiety from the remainder of the molecule (during development) and a cyclization reaction to take place to form a cyclic structure containing the atoms of the —$G_1$-$R_2$ moiety. Examples thereof include those described in JP-A-63-29751 (the term "JP-A" as used herein means an "unexamined published Japanese patent application"). An example of the ring forming reaction is shown below:

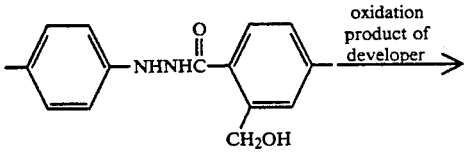

-continued

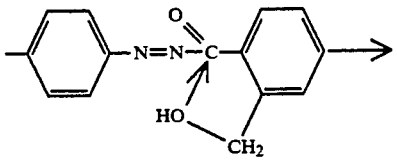

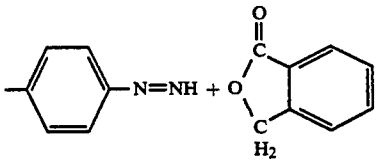

In formula (I), $G_1$ is most preferably a —CO— group.

$A_1$ and $A_2$ are each most preferably a hydrogen atom. The total number of carbon atoms of each of $A_1$ and $A_2$ is 1 to 18. Examples of substituents include those which are cited as substituents for $R_1$ below.

$R_1$ or $R_2$ in formula (I) may have a ballast group as a substituent for $R_1$ or $R_2$ conventionally used in immobile photographic additives such as couplers or a polymer moiety. The ballast group is a group which has not less than 8 carbon atoms and is relatively inert to photographic characteristics. Examples of the ballast group include an alkyl group, an alkoxy group, a phenyl group, an alkylphenyl group, a phenoxy group an alkylphenoxy group. Examples of the polymer include those described in JP-A-1-100530.

$R_1$ or $R_2$ in formula (I) may have a group as a substituent capable of enhancing adsorption on the surfaces of silver halide grains. Examples of such an adsorption-enhancing group include groups such as a thiourea group, a heterocyclic thioamido group, mercapto heterocyclic group and a triazole group, as described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-4244, JP-A-63-234245 and JP-A-63-234246.

Examples of the compounds of formula (I) include, but are not limited to, the following compounds.

I-1

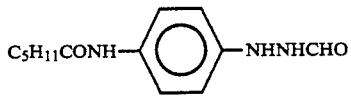

I-2

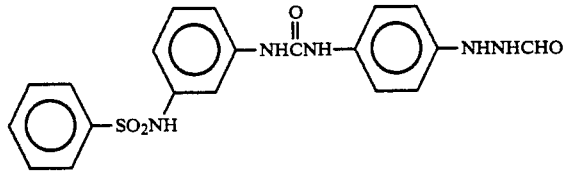

I-3

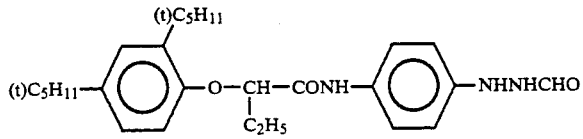

-continued
I-4
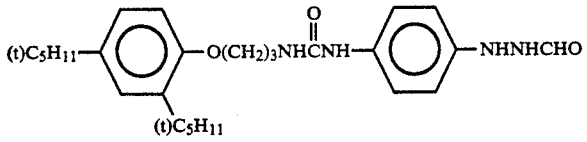
I-5
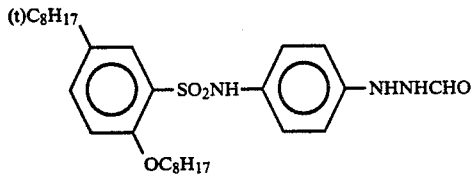
I-6
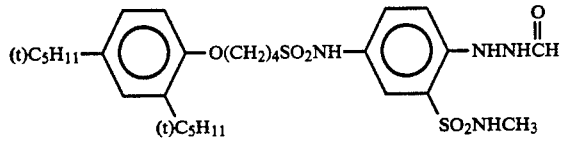
I-7
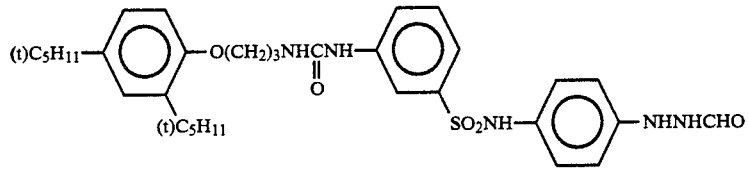
I-8
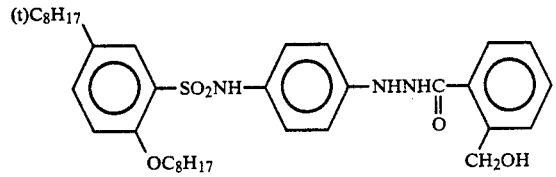
I-9
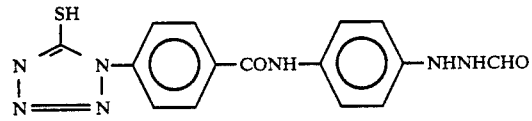
I-10
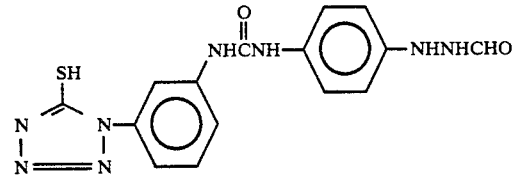
I-11
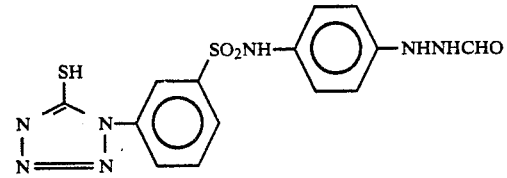
I-12
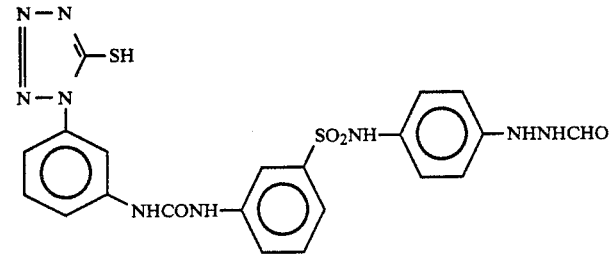

-continued

I-13

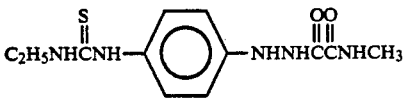

I-14

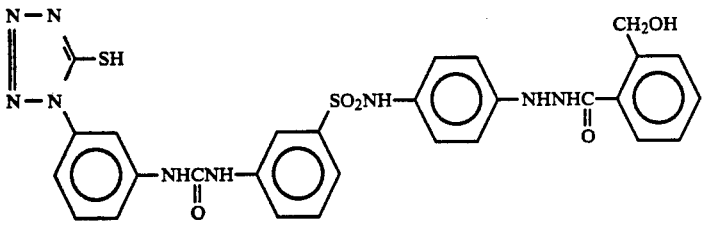

I-15

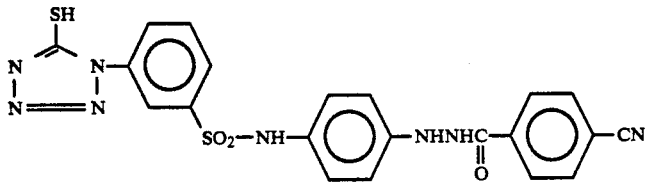

With regard to hydrazine derivatives which can be used in the present invention in addition to the above-described compounds, reference can be made to *Research Disclosure* Item 23516 (p. 346, November 1983) and the literature cited therein, U.S. Pat. Nos. 4,080,207, 4,269,929, 4,276,364, 4,278,748, 4,385,108, 4,459,347, 4,560,638 and 4,478,928, U.K. Patent 2,011,391B, JP-A-60-179734, JP-A-62-270948, JP-A-63-29751, JP-A-61-170733 JP-A-61-270744, JP-A-62-948, EP 217,310, U.S. Pat. No. 4,686,167, JP-A-62-178246, JP-A-63-32538, JP-A-63-104047, JP-A-63-121838, JP-A-2-12236 (line 19 of right upper column of page 2 to line 3 of right upper column of page 7) and JP-A-3-174143 (compounds of general formula (II) and compounds II-1 to II-54 described in the first line of right lower column of page 20 to the 20th line of right upper column of page 27).

Methods for production of the hydrazine derivatives are disclosed, for example, JP-A-53-20921, JP-A-53-20922, JP-A-53-66732, JP-A-53-20318, JP-A-56-67843, JP-A-62-178246, JP-A-62-180361, JP-A-63-121838, JP-A-63-234245, JP-A-63-294552, JP-A-63-306438, and U.S. Pat. Nos. 4,459,347, 4,478,928, and 4,560,638.

The addition amount of the hydrazine derivative in the present invention is preferably in the range of $1\times10^{-6}$ mol to $5\times10^{-2}$ mol, particularly $1\times10^{-5}$ mol to $2\times10^{-2}$ mol per mol of silver halide in the previously fogged silver halide emulsion layer.

The hydrazine derivatives may be used by dissolving them into a water miscible organic solvent, for example, alcohols (e.g., methanol, ethanol, propanol, and fluorinated alcohol), ketones (e.g., acetone and methyl ethyl ketone), dimethylformamide, dimethylsulfoxide and methylcellosolve.

Alternatively, the hydrazine derivatives may be used according on an emulsion-dispersion method using an oil such as dibutyl phthalate, tricresyl phosphate, glyceryl triacetate and diethyl phthalate with an auxiliary solvent such as ethyl acetate and cyclohexanone to dissolve the derivatives, and then forming mechanically an emulsion-dispersion.

Furthermore, the hydrazine derivatives may also be used according on a solid-dispersion method by dispersing powder of the hydrazine derivatives into water using ball-mill, colloid-mill or an ultrasonic wave.

The redox compound is oxidized during development by an oxidation product of a developing agent. For the development processing of the silver halide photographic light-sensitive material according to the present invention, a developing agent conventionally used for development of silver halide photographic materials, for example, the organic or inorganic developing agents and developing aids described in *The Theory of the Photographic Process* written by E. K. Meath & T. H. James, vol. 3, pp. 278–381 (1966) singly or in combination thereof. Preferred are ferrous oxalate, hydroxylamine, N-hydroxymorpholine, hydroquinones such as hydroquinone, hydroquinone mono-sulfonate, chlorohydroquinone, and t-butylhydroquinone, catechol, resorcine, pyrrogalole, amidol, phenidone, pyrazolidones such as 4-hydroxymethyl-4-methyl-1-phenyl-3-pyrazolidone, paraminophenols such as paraminophenol, glycine and methole, paraphenylenediamines such as paraphenylenediamine and 4-amino-N-ethyl-N-ethoxy-aniline, and ascorbic acid. More preferred are singly methole, the combination of phenidone and methole, the combination of methole and hydroquinone, the combination of phenidone, methole and t-butylhydroquinone, the combination of phenidone and ascorbic acid, and the combination of phenidone and aminophenol.

The above developing agent which is allowed to incorporated into the developing solution used for the silver halide photographic light-sensitive material according to the present invention may be used generally in the amount of $1\times10^{-5}$ to 1 mole/liter of the developing solution. In particular, hydroquinone is used preferably in the amount of 20 g/liter or more, more preferably 25 g/liter or more. In addition to the above developing agent and a preservative such as sulfite and hydroxylamine, there can arbitrarily be added to the developing solution used for the silver halide photographic light-sensitive material according to the present invention, the compounds having the functions of pH controlling and buffer used for a general black-and-white developing solution, such as caustic alkali, alkali carbonate, alkali borate, and amines, an inorganic development inhibitor such as potassium bromide, and an organic development inhibitor such as benzimidazole, benzotriazole, and nitroindazole shown in British Patent 1,376,600.

The redox compounds which release a development restrainer when oxidized according to the present invention will be described below.

Preferred examples of the redox groups of the redox compounds include a hydroquinone moiety, a catechole moiety, a naphthohydroquinone moiety, an aminophenol moiety, a pyrazolidone moiety, a hydrazine moiety, a hydroxylamine moiety and a reductone moiety. Among them, a hydrazine moiety are more preferred.

Compounds represented by the following formulas (R-1), (R-2) and (R-3) are preferred as the hydrazines which can be used in the present invention as the redox compounds which release a development restrainer when oxidized.

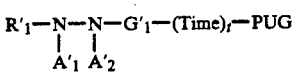

(R-1)

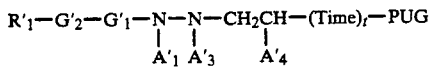

(R-2)

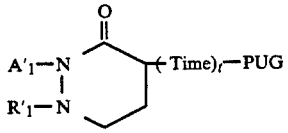

(R-3)

wherein $R'_1$ represents an aliphatic or alicyclic group or an aromatic group; $G'_1$ represents a —CO— group, —COCO— group, —CS— group, —C(=$NG'_2R'_2$)— group, —SO— group, —$SO_2$— group or —P(O)($G'_2R'_2$)— group; $G'_2$ represents a single bond, —O— group, —S— group or —N($R'_2$)— group; $R'_2$ has the same meaning as $R'_1$ or represents hydrogen atom and when two or more $R'_2$ groups exist in the molecule, they may be the same or different.

$A'_1$ and $A'_2$ each represents a hydrogen atom, an alkylsulfonyl group, an arylsulfonyl group (such as phenyl and naphthyl) or an acyl group, and these groups may be substituted.

In formula (R-1), at least one of $A'_1$ and $A'_2$ is hydrogen atom.

$A'_3$ has the same meaning as $A'_1$, or represents —$CH_2CH(A'_4)$—$(Time)_t$—PUG. $A'_4$ represents nitro group, cyano group, carboxyl group, a sulfonyl group or —$G'_1$— $G'_2$—$R'_1$ (when $A'_4$ is —$G'_1$—$G'_2$—$R'_1$, two $G'_1$—$G'_2$—$R'_1$ groups may be the same or different).

Time represents a bivalent bonding group; t represents 0 or 1; and PUG represents a development restraining moiety. When t=0, PUG directly bonds to the remained moiety.

The compounds of formulas (R-1), (R-2) and (R-3) will be described in more detail below.

The aliphatic or alicyclic group represented by $R'_1$ in formulas (R-1), (R-2) and (R-3) is a straight-chain, branched or cyclic alkyl group, preferably having 1 to 30 carbon atoms, particularly preferably 1 to 20 carbon atoms, which may be substituted. Examples of substituents are shown hereinafter.

The aromatic group represented by $R'_1$ in formulas (R-1), (R-2) and (R-3) is a monocyclic or bicyclic aryl group or an unsaturated heterocyclic group containing at least one of N, O and S atoms, more preferably containing at least one of N and S atoms. The unsaturated heterocyclic group may be fused together with the aryl group to form a heteroaryl group.

Examples of the aromatic group represented by $R'_1$ include a benzene ring, naphthalene ring, pyridine ring, quinoline ring and isoquinoline ring. Among them, a group having a benzene ring is preferred.

Particularly preferably, $R'_1$ is an aryl group.

The alkyl group, the aryl group or the unsaturated heterocyclic group represented by $R'_1$ may be substituted. Typical examples of substituent groups include an alkyl group, an aralkyl group, an alkenyl group, an alkynyl group, an alkoxy group, an aryl group, a substituted amino group, a ureido group, a urethane group (such as an alkoxycarbonylamino group and aryloxycarbonylamino group), an aryloxy group, a sulfamoyl group, a carbamoyl group, an alkylthio group, an arylthio group, an alkyl- or aryl-sulfonyl group, an alkyl- or aryl-sulfinyl group, a hydroxy group, a halogen atom (such as F, Cl, Br and I), a cyano group, a sulfo group, an aryloxycarbonyl group, an acyl group, an alkoxycarbonyl group, an acyloxy group, an acylamino group, a sulfonamido group, a carboxyl group and a phosphoric acid amido group.

Preferred examples of the substituent groups include a straight-chain, branched or cyclic alkyl group (preferably having. 1 to 20 carbon atoms), an aralkyl group (preferably having 7 to 30 carbon atoms), an alkoxy group (preferably having 1 to 30 carbon atoms), a substituted amino group (preferably, an amino group substituted by at least one alkyl group having 1 to 30 carbon atoms), an acylamino group (preferably having 2 to 40 carbon atoms), a sulfonamido group (preferably having 1 to 40 carbon atoms), a ureido group (preferably having 1 to 40 carbon atoms) and a phosphoric acid amido group (preferably having 1 to 40 carbon atoms). These substituents may be further substituted with at least one of substituents for $R'_1$. The substituents of which numbers of carbon atoms are not shown preferably has carbon atoms of 1 to 30.

In formulas (R-1), (R-2) and (R-3), $G'_1$ is preferably a —CO— group or —$SO_2$— group with a —CO— group being most preferred.

$A'_1$ and $A'_2$ are each preferably a hydrogen atom, and $A'_3$ is preferably a hydrogen atom or —$CH_2CH(A'_4)$—$(Time)_t$-PUG.

In formulas (R-1), (R-2) and (R-3), Time is a bivalent bonding group and has a timing controlling function.

The bivalent bonding group represented by Time is a group which releases PUG from Time-PUG through a one or more stage reaction, Time-PUG is released from the oxidation product of an oxidation-reduction basic nucleus.

Preferred embodiments of the bivalent bonding group represented by Time are fully described in JP-A-61-236549 (corresponding to U.S. Pat. No. 4,770,990), and JP-A-3-67246.

In formulas (R-1), (R-2) and (R-3), PUG is a development restraining moiety, has at least one heteroatom and is bonded to remained moiety of the compound of formula (R-1), (R-2) or (R-3) through a heteroatom.

Examples of conventional development restrainers generally known are described in T. H. James, *The Theory of the Photographic Process,* the 4th addition, pp. 396–399 (1977) (Macmillan) and JP-A-3-67246 (pages 56 to 69).

The moiety of these development restraining moieties may be substituted. Examples of useful substituent groups include a mercapto group, a nitro group, a carboxyl group, a sulfo group, a phosphono group, a hydroxy group, an alkyl group, an aralkyl group, an alkenyl group, an alkynyl group, an aryl group, an alkoxy group, an aryloxy group, an amino group, an acylamino group, a sulfonylamino group, a ureido group, a urethane group (such as an alkoxycarbonylamino group and an aryloxycarbonylamino group), a sulfamoyl group, a carbamoyl group, an alkylthio group, an arylthio group, an alkyl- or aryl-sulfonyl group, an alkyl- or arylsulfinyl group, a halogen atom (such as F, Cl, Br and I), a cyano group, an aryloxycarbonyl group, an acyl group, an alkoxycarbonyl group, an acyloxy group, a carbonamido group, a sulfonamido group and a phosphonamido group. The number of carbon atoms of these groups is preferably not more than 12. These groups may be further substituted with at least one of these substituents.

It is preferred that the development restraining moiety represented by PUG in the present invention is a moiety which restrains nucleating infectious development, that is, a nucleating development restraining moiety.

The nucleating development restraining moiety may be substituted. The intensity of development restraint, easy diffusion and other various characteristics can be controlled by the properties of substituent groups, such as electron attractive property, electron donative property, hydrophobicity, hydrophilicity, charge, adsorptivity on silver halide, etc.

Examples of useful substituent groups include those already described above in the definition of substituent groups for conventional development restrainers.

The details of nucleating restrainers, examples of useful nucleating restrainers of the present invention and preferred embodiments thereof are described in JP-A-4-136839, JP-A-4-136840, JP-A-4-136841, JP-A-4-283743, JP-A-4-278939, Japanese Patent Application Nos. 3-108330 and 3-113670.

In formulas (R-1), (R-2) and (R-3), $R'_1$ or Time may have (as a substituent) a ballast group conventionally used in immobile photographic additives such as couplers, or may have a group capable of accelerating the adsorption of the compounds of formulas (R-1), (R-2) and (R-3) on silver halide.

The ballast group can be an organic group which imparts a sufficient molecular weight so that the compounds of formulas (R-1), (R-2) and (R-3) are substantially not diffused in other layers or processing solutions. Examples of the ballast group include an alkyl group, an aryl group, a heterocyclic group, an ether group (e.g., alkoxy and aryloxy), a thioether group (e.g., alkylthio and arylthio), an amido group, a ureido group, a urethane group (e.g., alkoxycarbonylamino and aryloxycarbonylamino), a sulfonamido group and a combination of two or more of these groups. A ballast group having a substituted benzene ring is preferred. A ballast group having a branched alkyl group-substituted benzene ring is particularly preferred.

Examples of the adsorption accelerating group include a cyclic thioamido group, such as those derived from 4-thiazoline-2-thione, 4-imidazoline-2-thione, 2-thiohydantoin, rhodanine, thiobarbituric acid, tetrazoline-5-thione, 1,2,4-triazoline-3-thione, 1,3,4-oxazoline-2-thione, benzimidazoline-2-thione, benzoxazoline-2-thione, benzthiazoline-2-thione, thiotriazine and 1,3-imidazoline-2-thione; a linear thioamido group; an aliphatic mercapto group; an aromatic mercapto group; a heterocyclic mercapto group (when the atom next to the carbon atom to which the —SH group is attached is a nitrogen atom, the heterocyclic mercapto group and the cyclic thioamido group exist in a tautomeric form, and examples of the heterocyclic mercapto group include those already described above in the examples of the cyclic thioamido group); a group having a disulfide bond; a five-membered or six-membered nitrogen-containing heterocyclic group composed of a combination of hetero-atoms such as nitrogen, oxygen and/or sulfur and carbon atoms such as benztriazole, triazole, tetrazole, indazole, benzimidazole, imidazole, benzthiazole, thiazole, thiazoline, benzoxazole, oxazole, oxazoline, thiadiazole, oxathiazole, triazine and azaindene; and heterocyclic quaternary salts such as benzimidazolinium.

These groups may be further substituted. Examples of substituent groups include those already described above in the definition of the substituent group for $R'_1$ in formulas (R-1), (R-2) and (R-3).

Particular examples of the redox compounds which can be used in the present invention are described in JP-A-61-213847, JP-A-62-260153, EP393711A, EP393721A, JP-A-3-67246, JP-A-3-39949, JP-A-3-39953, JP-A-3-39951, JP-A-4-136839, JP-A-4-136840, JP-A-4-136841, EP495477A, JP-A-4-283743, JP-A-4-316038 and JP-A-4-320254.

Specific examples of the compounds which can be preferably used in the present invention include, but are not limited to, the following compounds.

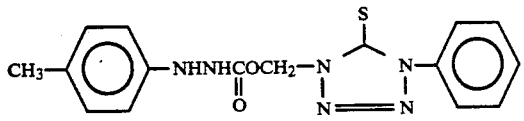

R-1

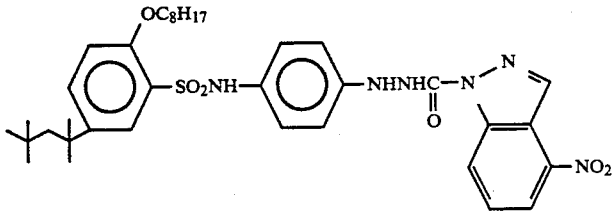

R-2

-continued
R-3
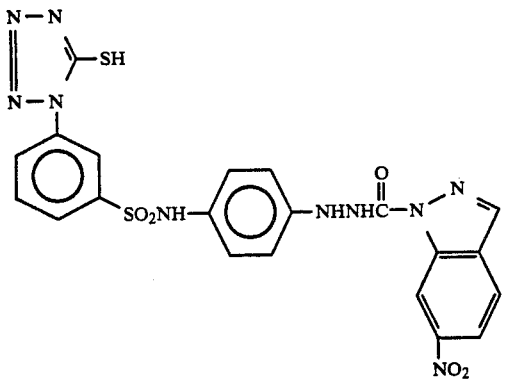
R-4
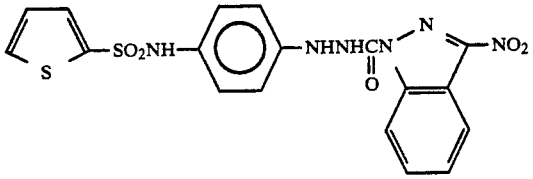
R-5
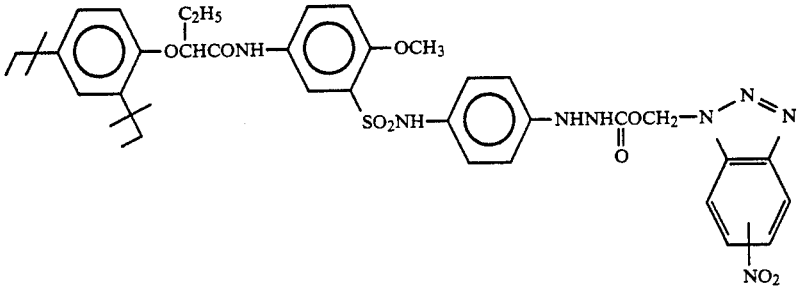
R-6
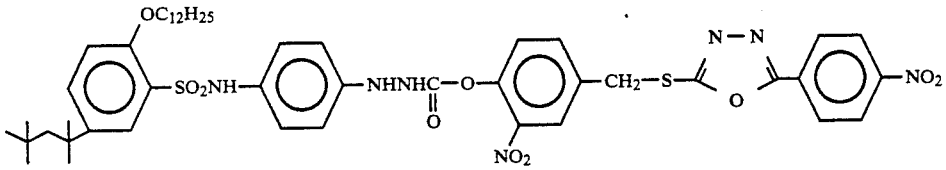
R-7
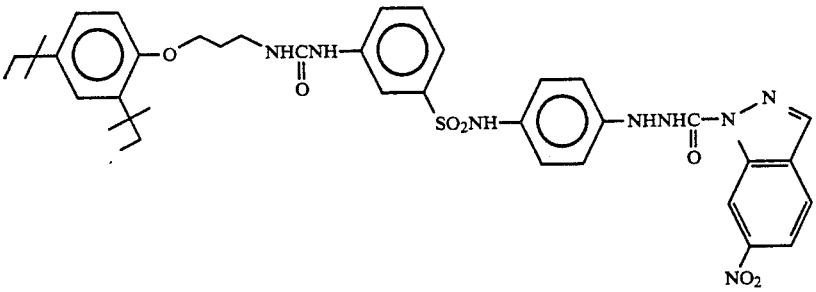
R-8
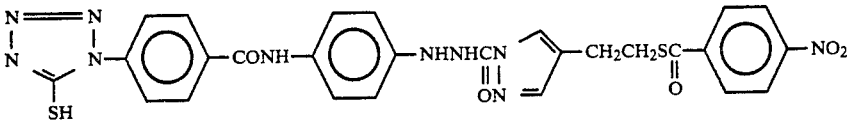

-continued
R-9
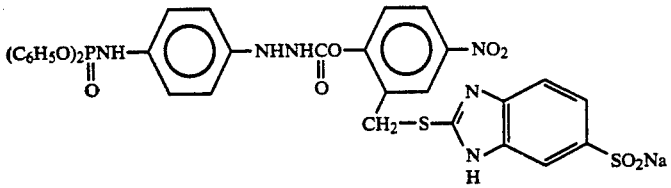
R-10
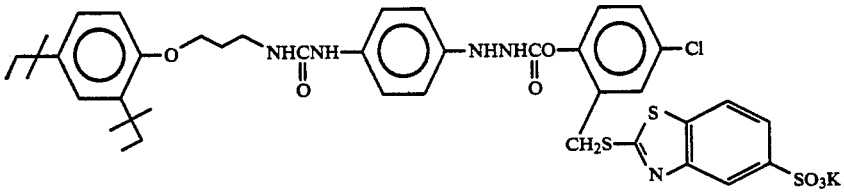
R-11
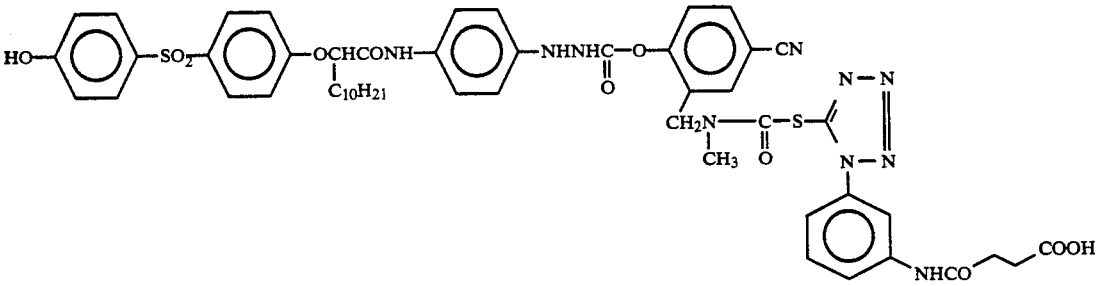
R-12
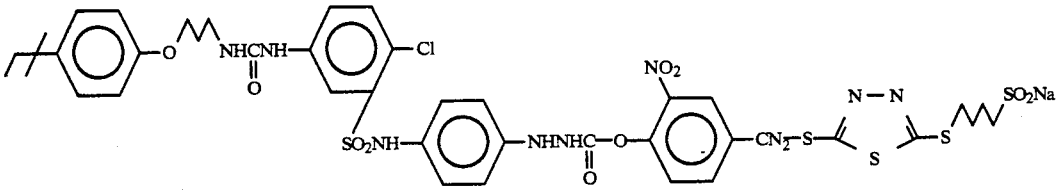
R-13
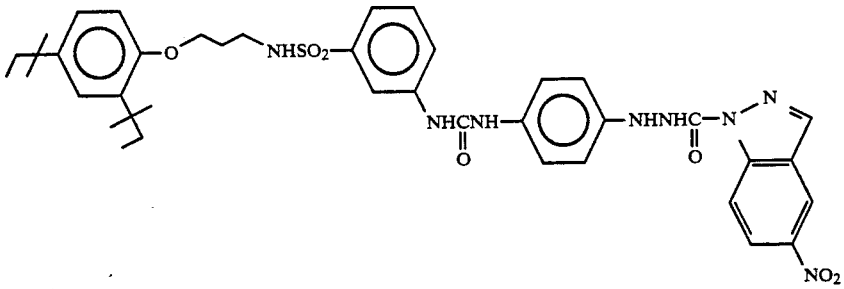
R-14
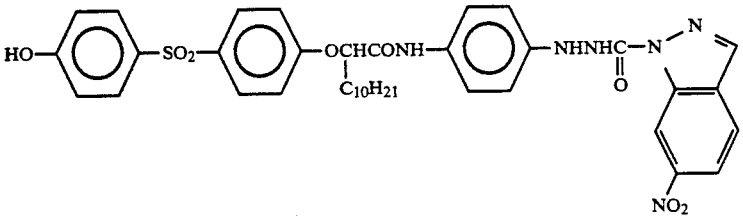

-continued

R-15

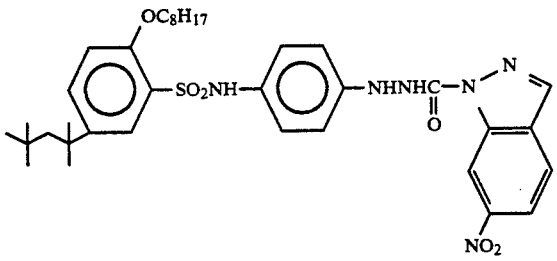

R-16

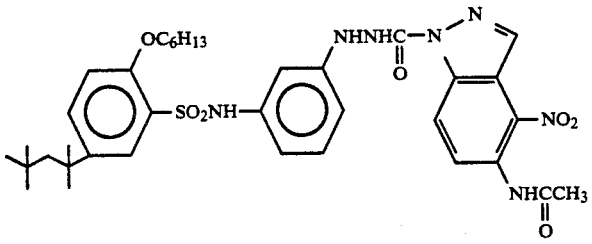

R-17

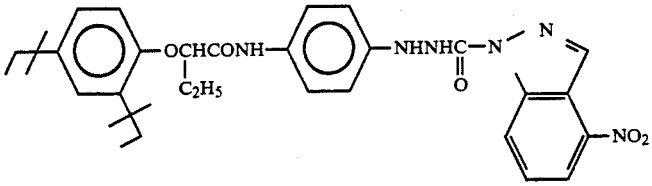

R-18

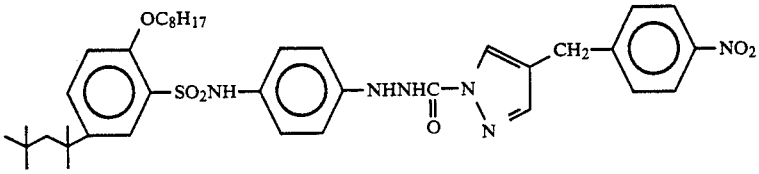

R-19

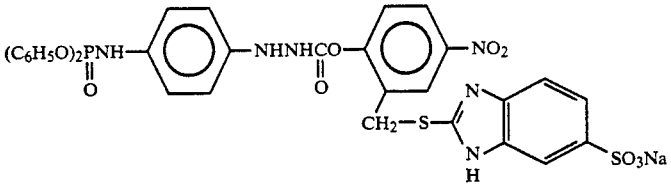

R-20

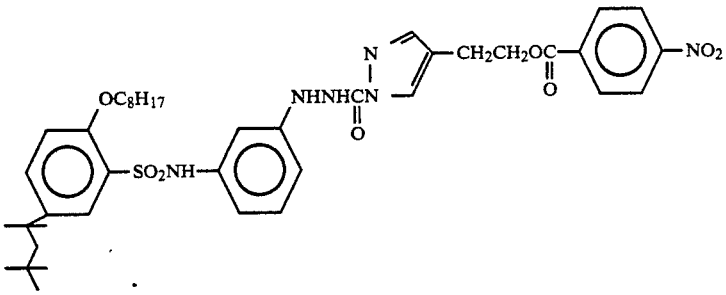

The redox compounds which are used in the present invention can be synthesized by the methods disclosed in for example, JP-A-61-231,847, JP-A-62-260,153, U.S. Pat. Nos. 4,684,604, 3,379,529, 3,620,746, 4,377,634 and 4,332,878, JP-A-49-129,536, JP-A-56-153,336, JP-A-153,342 and JP-A-1-269,936.

The redox compounds of the present invention are used in an amount of $5\times10^{-6}$ to $5\times10^{-2}$ mol, preferably $1\times10^{-5}$ to $1\times10^{-2}$ mol, per mol of silver halide in the light sensitive silver halide emulsion layer.

The redox compounds of the present invention can be used by dissolving them in an appropriate water-miscible organic solvent such as an alcohol (e.g., methanol, ethanol, propanol, fluorinated alcohol), a ketone (e.g., acetone, methyl ethyl ketone), dimethylformamide, dimethyl sulfoxide, or methyl cellosolve.

The redox compounds may be used as an emulsified dispersion prepared by a conventional emulsifying dispersion method, for example, by dissolving them in the presence of an oil such as dibutyl phthalate, tricresyl phosphate, glyceryl triacetate or diethyl phthalate, or an auxiliary solvent such as ethyl acetate or cyclohexanone and mechanically conducting emulsifying dispersion. The redox compounds may be dispersed in water by a conventional solid dispersion method, for example, by a dispersing the powder of the redox compound in water in a ball mill or a colloid mill or by means of ultrasonic dispersion.

Generally, gelatin is used as the hydrophilic colloid in the light-sensitive silver halide emulsion layer, the previously fogged silver halide emulsion layer, and the hydrophilic colloid layer, however, any other hydrophilic colloids conventionally used in silver halide photographic material may also be used in the present invention.

The light-sensitive silver halide emulsion which is used in the present invention is described below.

The light-sensitive silver halide emulsion is a dispersion of silver halides such as silver chloride, silver iodide, silver bromide, silver chlorobromide, silver iodobromide, and silver chloroiodobromide in hydrophilic colloid.

In general, light-sensitive silver halide emulsions are prepared by mixing water-soluble silver salts (e.g., silver nitrate) and water soluble halides in the presence of water and hydrophilic colloid in accordance with conventional well-known techniques, for example, single jet, double jet, and controlled jet techniques, followed by physical ripening and chemical ripening such as gold and/or sulfur sensitization. No particular limit is imposed on the shape of silver halide grains used herein. Cubic, octahedral and spherical silver halide grains may be used as well as plate-shaped grains having a high aspect ratio as described in Research Disclosure, 22534 (January 1983).

The silver halide emulsion used herein may be either a multi-dispersed one or a mono-dispersed one having a narrow grain size distribution. Mono-dispersed emulsions having a dispersion coefficient of up to 20% are preferred for graphic printing photosensitive materials. By the term mono-dispersed emulsion is meant a silver halide emulsion having a grain size distribution with a coefficient of variation of up to 20%, especially up to 15%. The coeeficient of variation is defined as (standard deviation of grain size)/(average of grain size)$\times$100%.

The silver halide grains may have a uniform phase or different phases between the interior and the surface. Also useful is a mixture of two or more types of silver halide emulsions which are separately formed.

In the silver halide emulsion used herein, a cadmium salt, sulfite salt, lead salt, thallium salt, rhodium salt or complex salt, and iridium salt or complex salt may be copresent during formation or physical ripening of silver halide grains. Particularly when it is desired to impart high contrast or to improve reciprocity low failure, it is preferred to prepare a silver halide emulsion while an iridium salt is present in an amount of $10^{-8}$ to $10^{-3}$ mol per mol of the silver halide. The silver halide emulsion used herein may also contain at least one of iron, rhenium, ruthenium, and osmium compounds in an amount of up to $10^{-3}$ mol, preferably $10^{-6}$ mol to $10^{-4}$ mol per mol of silver.

If desired, the silver halide emulsion used herein may be chemically sensitized. Chemical sensitization may be effected by well-known methods such as sulfur, reduction and gold sensitization methods. Preferred is sulfur sensitization. The sulfur sensitizing agents include sulfur compounds contained in gelatin and various sulfur compounds, for example, thiosulfates, thioureas, thiazoles, and rhodanines. Exemplary compounds are described in U.S. Pat. Nos. 1,574,944, 2,278,947, 2,410,689, 2,728,668, 3,501,313 and 3,656,955. Preferred sulfur compounds are thiosulfates and thioureas. Chemical sensitization favors pAg 8.3 or lower, especially pAg 7.3 to 8.0. Satisfactory results are also obtained with the use of polyvinyl pyrrolidone in combination with a thiosulfate as reported by Moisar, Klein & Glatione, Proc. Symp., 2nd, 301-309 (1970).

Gold sensitization is typical of noble metal sensitization methods and uses gold compounds, often gold complex salts. Also useful are complex salts of noble metals other than gold, such as platinum, palladium and iridium. Exemplary salts are described in U.S. Pat. No. 2,448,060 and U.K. Patent No. 618,061.

The reduction sensitizing agents include stannous salts, amines, sulfinoformaridine, dialkylaminoborans, and silanes, examples of which are described in U.S. Pat. Nos. 2,487,850, 2,518,698, 2,694,637, 2,983,609 and 2,983,610.

The light-sensitive silver halide grains used herein may be spectrally sensitized with sensitizing dyes. The dyes used herein includes cyanine dyes, merocyanine dyes, complex cyanine dyes, complex merocyanine dyes, holopolar cyanine dyes, hemicyanine dyes, styryl dyes, and hemioxonol dyes. Particularly useful dyes among them are cyanine, merocyanine, and complex merocyanine dyes. For these dyes, any nucleus generally utilized for cyanine dyes can be applied as a basic heterocyclic ring nucleus. Most preferred are carbocyanine sensitizing dyes. Specific examples are described in Research Disclosure, Vol. 170, RD-17643 (December 1978), page 23, U.S. Pat. Nos. 4,425,425 and 4,425,426.

In general, the sensitizing dye is added to the emulsion prior to its application to a suitable support although it may be added during chemical ripening step or silver halide grain forming step.

The emulsion layer of the photosensitive material used herein may contain plasticizers, for example, polymers such as alkyl acrylate latexes, emulsions thereof, and polyols such as trimethylol propane.

The binder or protective colloid of the photographic emulsion is advantageously gelatin although other hydrophilic colloids may be used. Useful are synthetic hydrophilic high-molecular weight substances, for example, gelatin derivatives, graft polymers of gelatin and other polymers, protein hydroxyethyl celluloses such as albumin and casein, cellulose derivatives such as carboxymethyl cellulose and cellulose sulfate ester, sodium alginate, saccharide derivatives such as starch derivatives, and homopolymers and copolymers such as polyvinyl alcohol, polyvinyl alcohol partial acetal, poly-N-vinylpyrrolinone, polyacrylic acid, polymethacrylic acid, polyacrylamide, polyvinylimidazole, and polyvinylpyrazole.

The gelatin used may be lime treated gelatin, acid treated gelatin, hydrolyzed gelatin, or enzymatically decomposed gelatin.

Various additives, development processing methods, etc. described in the following patent specifications can be preferably applied to the light-sensitive materials of the present invention without particular limitation.

| Item | Applicable places |
|---|---|
| (1) Nucleating accelerator | Compounds of general formulas (II-m) to (II-p) and compounds II-1 to II-22 |

-continued

| Item | Applicable places |
|---|---|
| | described in JP-A-2-103536 (th 13th line of the right upper column of page 9 to the 10th line of the left upper column of page 16); and compounds described in JP-A-1-179939 |
| (2) Silver halide emulsion and preparation thereof | The 12th line of the right lower column of page 20 to the 14th line of the left lower column of page 21 of JP-A-2-97937; the 19th line of the right upper column of page 7 to the 12th line of the left lower column of page 8 of JP-A-2-12236; and the selenium sensitization method described in EP514675A. |
| (3) Spectral sensitizing dye | The 13th line of the left lower column of page 8 to the 4th line of the right lower column of page 8 of JP-A-2-12236; the third line of the right lower column of page 16 to the 20th line of the left lower column of page 17 of JP-A-2-103536; and the spectral sensitizing dyes described in JP-A-1-112235, JP-A-2-124560, JP-A-3-7928 and EP514675A. |
| (4) Surfactant | The 7th line of the right upper column of page 9 to the 7th line of the right lower column of page 9 of JP-A-2-12236; and the 13th line of the left lower column of page 2 to the 18th line of the right lower column of page 4 of JP-A-2-118542. |
| (5) Anti-fogging agent | The 19th line of the right lower column of page 17 to the 4th line of the right upper column of page 18 of JP-A-2-103536; the first line to the 5th line of the right lower column of page 18 of JP-A-2-103536; and the thiosulfinic acids described in JP-A-1-237538. |
| (6) Polymer latex | The 12th line to the 20th line of the left lower column of page 18 of JP-A-2-103536. |
| (7) Compound having an acid group (pepper fog inhibitor) | The 6th line of the right lower column of page 18 to the first line of the left upper column of page 19 of JP-A-2-103536. |
| (8) Matting agent, lubricant, plasticizer | The 15th line of the left upper column of page 19 to the 15th line of the right upper column of page 19 of JP-A-2-103536. |
| (9) Hardening agent | The 5th line to the 17th line of the right upper column of page 18 of JP-A-2-103536. |
| (10) Dye | Dyes described in (the first line to the 18th line of the right lower column of page 17); and the solid dyes described in JP-A-2-294638 and JP-A-5-11382. |
| (11) Binder (may also be used in the hydrophilic colloid layer) | The first line to the 20th line of the right lower column of page 3 of JP-A-2-18542. |
| (12) Pepper fog inhibitor | Compounds described in U.S. Pat. No. 4,956,257 and JP-A-1-118832. |
| (13) Monomethine compound (pepper fog inhibitor) | Compounds of general formula (II) (particularly compounds II-1 to II-26) described in JP-A-2-287532. |
| (14) Dihydroxybenzenes (fog inhibitor, especially, for pressure fog) | Compounds described in JP-A-3-39948 (the left upper column of page 11 to the left lower column of page 12) and EP 452,772A |
| (15) Developing solution and development method | The 16th line of the right upper column of page 19 to the 8th line of the left upper column of page 21 of JP-A-2-103536 |

The silver halide photographic materials of the present invention may have various layer structures. Examples of the layer structures which can be used in the present invention include a structure wherein the previously fogged silver halide emulsion layer containing a hydrazine nucleating agent (the first emulsion layer), the light-sensitive silver halide emulsion layer containing a redox compound capable of releasing a development restrainer (the second emulsion layer) and a protective layer in this order are provided on a support; and a structure wherein the light-sensitive silver halide emulsion layer containing said redox compound, the previously fogged silver halide emulsion layer containing the hydrazine nucleating agent and the protective layer in this order are provided on the support. If desired, a non-sensitive interlayer comprising hydrophilic colloid may be optionally provided between two silver halide emulsion layers. The thickness of each layer can be chosen based on the layer structure used.

The redox compound and the hydrazine nucleating agent may also be incorporated into an interlayer or a protective layer which is adjacent to the light-sensitive silver halide emulsion layer and the previously fogged silver halide emulsion layer, respectively. However, the redox compound and the hydrazine nucleating agent may not be incorporated into the same layer.

The previously fogged silver halide emulsion layer is a principal layer for forming a reversal image and is coated in an amount of 0.3 to 7.0 g/m$^2$, preferably 0.6 to 5.0 g/m$^2$ in terms of silver. The light-sensitive silver halide emulsion layer containing the redox compound is a layer which functions as a trigger for reversal and is coated in such a small amount that the coating weight of the layer has substantially no effect on the density of the image. The light-sensitive silver halide emulsion layer containing the redox compound is coated in an amount of preferably 0.03 to 1.5 g/m$^2$, more preferably 0.1 to 0.8 g/m$^2$ in terms of silver. The amount of the hydrophilic colloid in the interlayer preferably is 0.1 to 3.0 g/m$^2$ when provided.

The reversal method of the present invention can be applied to various photographic fields. For example, the present invention can be applied to the following fields.

(1) Application to photographing with a camera, phototypesetting and scanner photographic films as duplicate photographic materials for printing plate making.

(2) Silver salt diffusion transfer process and color diffusion transfer process.

(3) Color image formation by using black-and-white development.

(4) Color image formation by using heat development (e.g., dry and semi-dry system).

(5) General-purpose black-and-white photographic materials, and photographic materials for the movies.

Any dye image forming materials (such as coupler) known in the dye image production method may be used for color image production in the present invention. Furthermore, the photographic material may form a multilayered structure. When the material has a cyan coupler, magenta coupler and yellow coupler layers, the layer structure of the present invention should be applied to each of layers.

The present invention is now illustrated in greater detail by reference to the following examples which, however, are not to be construed as limiting the present invention in any way.

EXAMPLE 1

Preparation and Coating of Previously Fogged Silver Halide Emulsion

An aqueous solution of silver nitrate and an aqueous solution containing potassium iodide and potassium bromide were simultaneously added to an aqueous gelatin solution kept at 50° C. in the presence of $4\times10^{-7}$ mol of potassium hexachloroiridate (III) per mol of silver and ammonia over a period of 60 minutes while keeping the pAg at 7.8 to prepare a cubic monodisperse emulsion containing AgBrI grains having a mean grain size of 0.35μ and an average silver iodide content of 0.3 mol %. The emulsion was desalted by a flocculation method, and 40 g of inert gelatin per mol of silver was then added thereto.

One mg of thiourea dioxide and 0.6 mg of chloroauric acid were added to the emulsion, each amount being per mol of silver. The emulsion was ripened at 65° C. to fog it.

After the emulsion was re-dissolved, hydrazine nucleating agent (I-3) ($7.1\times10^{-5}$ mol/m$^2$) was added thereto, and further the following compounds (a), (b) and (c) were added thereto. The resulting emulsion was coated on an undercoated polyester film of 100 μ in thickness in such an amount as to give a coating weight of 3.4 g/m$^2$ in terms of silver.

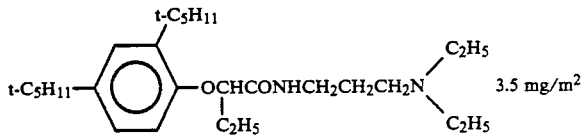

(nucleating development accelerator)

(a)

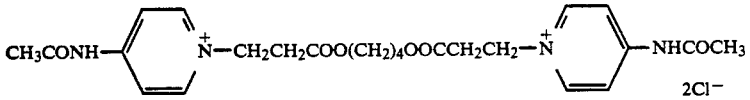

(development accelerator) 15.0 mg/m$^2$ (b)

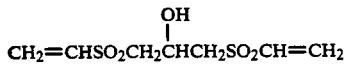

2.0 wt %

(based on the amount of gelatin)
(hardening agent)

(c)

Coating of Interlayer

A layer comprising gelatin (1.2 g/m$^2$) and 20 wt % (based on the amount of gelatin) of the hardening agent (c) for gelatin.

Light-sensitive Silver Halide Emulsion Layer

An aqueous solution of silver nitrate and an aqueous solution of a mixture of sodium chloride and potassium bromide containing $2.7\times10^{-7}$ mol of ammonium hexachlororhodate(III) per mol of silver and $4\times10^{-7}$ mol of potassium hexachloroiridate(III) per mol of silver were simultaneously added to an aqueous gelatin solution (pH=4.0) kept at 50° C. at a given rate over a period of 30 minutes to prepare a silver chlorobromide monodisperse emulsion (AgCl was 70 mol % in AgBrCl) having a mean grain size of 0.23 μ.

The emulsion was washed with water by a conventional method to remove soluble salts. Sodium thiosulfate and potassium chloroaurate were added thereto, and chemical sensitization was carried out. Further, a solution of 0.1 mol % of potassium iodide per mol of silver was added thereto to carry out the conversion of the surfaces of grains.

Further, $1.0\times10^{-3}$ mol of potassium salt of 5-[3-(4-sulfobutyl)-5-chloro-2-benzoxazolidene]-1-hydroxyethoxyethyl-3-(2-pyridyl)-2-thiohydrantoin per mol of silver was added thereto.

Subsequently, redox compound (R-2) was added thereto, and the emulsion was coated in such an amount as to give a coating weight of 0.4 g/m$^2$ in terms of silver. The coating weight of the redox compound was $1.5\times10^{-4}$ mol/m$^2$.

Coating of Protective Layer

A protective layer comprising gelatin (0.7 g/m$^2$) and polymethyl methacrylate particles having an average particle size of 2.5μ (0.15 g/m$^2$) was coated thereon by using the following surfactants.

Surfactant

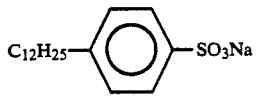

37 mg/m$^2$ (a)

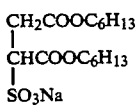

37 mg/m$^2$

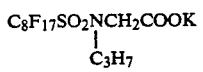

2.5 mg/m$^2$

Development Processing

The resulting photographic material was exposed to a tungsten light, developed at 34° C. for 30 minutes by using GRANDEX developing solution GR-$D_1$ (manufactured by Fuji Photo Film Co., Ltd.), fixed by using a fixing solution GR-$F_1$ (manufactured by Fuji Photo Film Co., Ltd.), rinsed with water and dried. The resulting image was measured by an autographic densitometer. The results are shown in FIG. 1 (curve a). A high-contrast reversal image was obtained in the region of low exposure.

The following two samples were prepared to analyze the phenomenon of the present invention.

Analysis sample A: This sample was prepared by removing the interlayer and the light-sensitive silver halide emulsion layer from the photographic material of the present invention.

Analysis sample B: This sample was prepared by removing the previously fogged silver halide emulsion layer from the photographic material of the present invention.

In the same manner as described above, these samples were exposed and processed. In FIG. 1, curve (a) shows the results of the sample of the present invention, curve (b) shows the results of the analysis sample A, and curve (c) shows the results of the analysis sample B. As shown in FIG. 1, the analysis sample A gave uniform high blackened silver irrespective of exposure. The analysis sample B gave delicate exposed developed silver.

It can be seen that when the light-sensitive emulsion layer containing the redox compound is developed, the development of the previously fogged silver halide emulsion layer is restrained and as a result, a reversal image is obtained.

EXAMPLE 2

The procedure of Example 1 was repeated except that redox compound (R-17) was used in place of redox compound (R-2).

Figure 2:
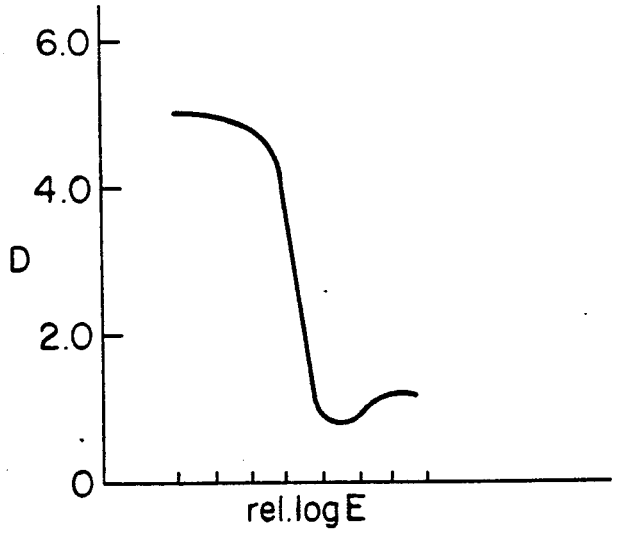
FIG. 2 is a characteristic curve of the photographic material obtained in Example 2, wherein the abscissae axis represents blackening density, and the ordinate axis represents relative exposure amount (rel. logE).

FIG. 2 shows the resulting sensitometry curve. A reversal image was obtained.

While the present invention has been described in detail and with reference to specific embodiments thereof, it is apparent to one skilled in the art that various changes and modifications can be made therein without departing from the spirit and the scope of the present invention.

What is claimed is:

1. A reversal type silver halide photographic material comprising a support having thereon a previously fogged silver halide emulsion layer and a light-sensitive silver halide emulsion layer comprising at least one silver halide, wherein at least one of said previously fogged silver halide emulsion layer and a hydrophilic colloid layer adjacent thereto contains at least one hydrazine nucleating agent and at least one of said light-sensitive silver halide emulsion layer and a hydrophilic colloid layer adjacent thereto contains at least one redox compound capable of releasing a development restrainer when oxidized, and wherein aid nucleating agent and said redox compound are not contained in the same layer.

2. The silver halide photographic material as claimed in claim 1, wherein said previously fogged silver halide emulsion is obtained by treating a silver halide emulsion with light or a chemical treatment.

3. The silver halide photographic material as claimed in claim 2, wherein said chemical treatment is conducted by using a educing agent.

4. The silver halide photographic material as claimed in claim 2, wherein a combination of a reducing agent with compound of a noble metal selected from the group consisting of gold and metals which are more electrically positive than silver is used in said chemical treatment.

5. The silver halide photographic material as claimed in claim 2, wherein the silver halide emulsion is fogged under reaction conditions of the pH of 5 to 7, the pAg of 7 to 9 and the temperature of 40° to 100° C.

6. The silver halide photographic material as claimed in claim 1, wherein said nucleating agent is a hydrazine derivative represented by formula (I):

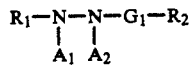

(I)

wherein $R_1$ represents an aliphatic or alicyclic group or an aromatic group; $R_2$ represents a hydrogen atom, an alkyl group, an aryl group, an alkoxy group, an aryloxy group, an amino group or a hydrazino group; $G_1$ represents a —CO— group, an —$SO_2$— group, an —SO— group, a group represented by the following formula (II)

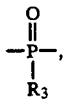

(II)

a —CO—CO— group, a thiocarbonyl group or an iminomethylene group; $A_1$ and $A_2$ each represents a hydrogen atom, or one of $A_1$ and $A_2$ represents a hydrogen atom and the other represents an alkylsulfonyl group, an arylsulfonyl group or an acyl group; and $R_3$ has the same meaning as $R_2$; said groups represented by $R_1$,$R_2$, $R_3$, $A_1$, $A_2$ and G may be substituted with at least one substituent.

7. The silver halide photographic material as claimed in claim 6, wherein said substituent is selected from the group consisting of an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkyl- or arylthio group, an alkyl- or arylsulfonyl group, an alkyl- or arylsulfinyl group, a hydroxy group, a halogen atom, a cyano group, a sulfo group, an aryloxycarbonyl group, an acyl group, an alkoxycarbonyl group, an acyloxy group, a carbonamido group, a sulfonamido group, a carboxyl group, a phosphoric acid amido group, a diacylamino group, an imido group and a group represented by formula (III);

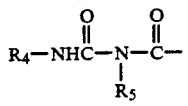

(III)

wherein $R_4$ and $R_5$ have the same meaning as $R_2$ and may be the same or different; a polymer moiety as a ballast group; a thiourea group, a heterocyclic thioamido group, a mercapto heterocyclic group and a triazole group as an adsorption-enhancing group.

8. The silver halide photographic material as claimed in claim 1, wherein said nucleating agent is used in an amount of from $1\times10^{-6}$ mol to $5\times10^{-2}$ mol per mol of silver halide in the previously fogged silver halide emulsion layer.

9. The silver halide photographic material as claimed in claim 1, wherein said redox compound has redox moiety selected from the group consisting of a hydroquinone moiety, a catechole moiety, a naphthohydroquinone moiety, an aminophenol moiety, a pyrazolidone moiety, a hydrazine moiety, a hydroxylamine moiety, and a reductone moiety.

10. The silver halide photographic material as claimed in claim 1, wherein said redox compound is selected from the group consisting of compounds represented by formulas (R-1), (R-2) and (R-3):

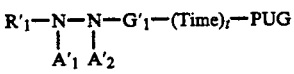

(R-1)

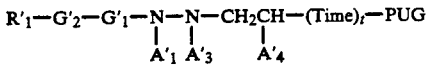

(R-2)

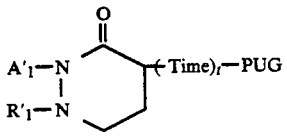

(R-3)

wherein $R'_1$ represents an aliphatic or alicyclic group or an aromatic group; $G'_1$ represents a —CO— group, —COCO— group, —CS— group, —C(=$NG'_2R'_2$)— group, —SO— group, —$SO_2$— group or —P(O)($G'_2R'_2$)— group; $G'_2$ represents a single bond, —O— group, —S— group or —N($R'_2$)— group; $R'_2$ has the same meaning as $R'_1$ or represents hydrogen atom and when two or more $R'_2$ groups exist in the molecule, they may be the same or different; $A'_1$ and $A'_2$ each represents a hydrogen atom, an alkylsulfonyl group, an arylsulfonyl group or an acyl group; said groups represented by $R_1'$, $A_1'$ and $A_2'$ each may be substituted with at least one substituent, and at least one of $A'_1$ and $A'_2$ is hydrogen atom; $A'_3$ has the same meaning as $A'_1$, or represents —$CH_2CH(A'_4)$—$(Time)_t$—PUG; $A'_4$ represents nitro group, cyano group, carboxyl group, a sulfonyl group or —$G'_1$—$G'_2$—$R'_1$; Time represents a bivalent bonding group; t represents 0 or 1; and PUG represents a development restraining moiety.

11. The silver halide photographic material as claimed in claim 10, wherein said substituent is selected from the group consisting of an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkylthio group, an arylthio group, an alkyl- or aryl-sulfonyl group, an alkyl- or aryl-sulfinyl group, a hydroxy group, a halogen atom, a cyano group, a sulfo group, an aryloxycarbonyl group, an acyl group, an alkoxycarbonyl group, an acyloxy group, an acylamino group, a sulfonamido group, a carboxyl group and, a phosphoric acid amido group.

12. The silver halide photographic material as claimed in claim 1, wherein said redox compound is incorporated in an amount of $1\times10^{-6}$ to $5\times10^{-2}$ mol per mol of silver halide in the light-sensitive silver halide emulsion.

13. The silver halide photographic material as claimed in claim 1, wherein said previously fogged silver halide emulsion layer is a principal layer for forming a reversal image.

14. The silver halide photographic material as claimed in claim 13, wherein said previously fogged silver halide emulsion is coated in an amount of 0.3 to 7.0 g/$m^2$ in terms of silver.

15. The silver halide photographic material as claimed in claim 1, wherein said light-sensitive silver halide emulsion layer is a trigger for reversal and is coated in such a small amount that the coating weight of the layer has substantially no effect on the density of the image.

16. The silver halide photographic material as claimed in claim 15, wherein said light-sensitive silver halide emulsion layer is coated in an amount of 0.03 to 1.5 g/$m^2$ in terms of silver.

* * * * *